United States Patent [19]

Tiefenbacher

[11] 4,175,911

[45] Nov. 27, 1979

[54] RADIAL TURBINE WHEEL FOR A GAS TURBINE

[75] Inventor: Eberhard Tiefenbacher, Ludwigsburg, Fed. Rep. of Germany

[73] Assignee: Daimler-Benz Aktiengesellschaft, Fed. Rep. of Germany

[21] Appl. No.: 904,593

[22] Filed: May 10, 1978

Related U.S. Application Data

[62] Division of Ser. No. 697,193, Jun. 17, 1976, Pat. No. 4,125,344.

[30] Foreign Application Priority Data

Jun. 20, 1975 [DE] Fed. Rep. of Germany ..... 2527498

[51] Int. Cl.[2] ..... F01D 5/28

[52] U.S. Cl. ..... 416/183; 416/241 B

[58] Field of Search ..... 416/95, 244 A, 241 B, 416/241 R, 183

[56] References Cited

U.S. PATENT DOCUMENTS

| | | | |
|---|---|---|---|
| 3,676,014 | 7/1972 | Bevan et al. | 416/241 B X |
| 3,887,411 | 6/1975 | Goodyear et al. | 416/241 B X |
| 3,905,723 | 9/1975 | Torti | 416/241 B |
| 4,063,850 | 12/1977 | Hueber et al. | 416/241 B X |
| 4,125,344 | 11/1978 | Tiefenbacher | 416/241 B X |

FOREIGN PATENT DOCUMENTS

| | | | |
|---|---|---|---|
| 1262290 | 3/1968 | Fed. Rep. of Germany | 416/183 |
| 1122205 | 9/1956 | France | 416/95 |
| 150852 | 7/1955 | Sweden | 416/241 B |
| 1148335 | 4/1969 | United Kingdom | 416/244 A |

*Primary Examiner*—Everette A. Powell, Jr.
*Attorney, Agent, or Firm*—Craig and Antonelli

[57] ABSTRACT

A radial turbine wheel for a gas turbine which consists of two parts and more particularly of a first part adjoining the turbine inlet which includes the outer sections of the blades and of a second part leading to the turbine outlet which includes the inner essentially curved section of the blades whereby the two parts are made of materials having different properties.

1 Claim, 5 Drawing Figures

RADIAL TURBINE WHEEL FOR A GAS TURBINE

This is a division of application Ser. No. 697,193, filed June 17, 1976, U.S. Pat. No. 4,125,344 dated Nov. 14, 1978.

The present invention relates to a radial turbine wheel for a gas turbine.

One possibility to improve the efficiency of gas turbines, consists in the increase of the fresh gas temperature. This, however, leads to an increased thermal load of the turbine blades which are already strongly loaded and stressed by the high centrifugal forces. Materials, which are able to withstand these loads, can be machined only with relatively great difficulty. They are therefore not suited for an economic manufacture of radial turbine wheels, whose blades are provided with a complicated shape in the inner area thereof.

The present invention is concerned with the task to eliminate these difficulties and to provide a radial turbine wheel for high temperatures which can be manufactured in an economic manner. This takes place according to the present invention in that the turbine wheel consists of two parts, and more particularly of a first part adjoining the turbine inlet which includes the outer section of the blades, and of a second part leading to the turbine outlet or discharge which includes the inner, essentially curved section of the blades, whereby the two parts have mutually different material properties. Such a manner of construction permits a large number of suitable material pairings which can be matched in an optimum manner to the operating conditions and manufacturing possibilities of the respective radial turbine wheel.

According to one advantageous embodiment of the present invention, the material of the first part of the turbine wheel distinguishes itself with respect to that of the second part by a higher heat resistance and/or higher strength and the material of the second part distinguishes itself with respect to that of the first part by an improved workability or machinability.

According to the present invention, the first part of the turbine wheel may consist of a ceramic material and the second part of a metallic material manufactured according to the high-quality or investment casting process. The use of a ceramic material thereby permits very high temperatures for the part adjoining the turbine inlet whereas the metallic material of the thermally and mechanically less strongly loaded part enables an economic manufacture of the curved section of the blades.

A particularly simple and inexpensive assembly of the turbine wheel results in that the two parts of the turbine wheel and the turbine shaft are held together under compressive stress by a central threaded connection.

According to the present invention the threaded connection may include an elastic intermediate member for purposes of compensation of different thermal expansions of the parts of the turbine wheel and of the turbine shaft.

According to a further advantageous embodiment of the present invention, the sections of the blades of at least one of the two parts of the turbine wheel project within the area of their contact plane by a slight amount beyond the adjoining section of the wheel body so that in the assembled condition of the turbine wheel, the sections of the blades are under a higher compressive stress than the sections of the wheel body. As a result of this measure, in which the mutually opposite sections of the blades are particularly strongly pressed together, gaps between the sections are avoided in every case and the danger of blade vibrations is considerably reduced or eliminated. For that purpose, a projection of the blades of no more than 0.1 mm. may already suffice.

Accordingly, it is an object of the present invention to provide a radial turbine wheel for a gas turbine which avoids by simple means the aforementioned shortcomings and drawbacks encountered in the prior art.

Another object of the present invention resides in a radial turbine wheel for high temperatures which can be manufactured in an economic manner.

A further object of the present invention resides in a radial turbine wheel for gas turbines which permits an optimum matching of the respective radial turbine wheel sections to the operating conditions and manufacturing possibilities.

Still a further object of the present invention resides in a radial turbine wheel of the type described above, in which the thermally highly loaded part is made of a high heat-resistant material whereas the thermally and mechanically less strongly stressed part is made of another material such as a metallic material which permits economic manufacture, particularly of the curved sections of the blades.

Another object of the present invention resides in a radial turbine wheel for a gas turbine which permits a particularly simple and inexpensive assembly of the various parts of the turbine wheel.

A further object of the present invention resides in a radial turbine wheel of the type described above which readily compensates for different thermal expansions of the various parts of the turbine wheel, while at the same time avoiding vibrations of the blades thereof.

These and other objects, features and advantages of the present invention will become more apparent from the following description when taken in connection with the accompanying drawing which shows, for purposes of illustration only, several embodiments in accordance with the present invention, and wherein.

Figure 1:
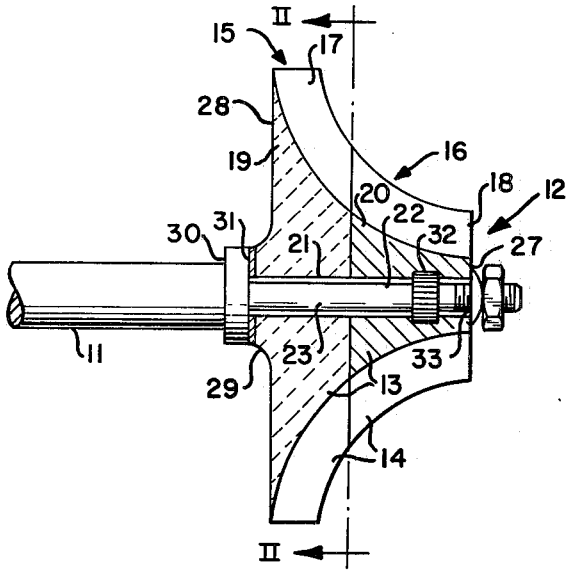
FIG. 1 is a longitudinal cross-sectional view through a radial turbine wheel for a motor vehicle gas turbine in accordance with the present invention.
Figure 2:
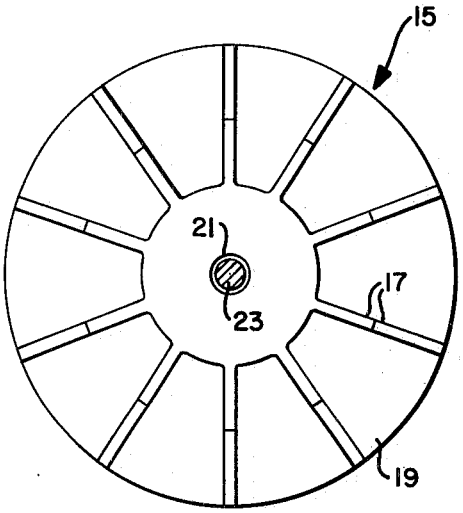
FIG. 2 is a cross-sectional view taken along line II—II of FIG. 1.
Figure 3:
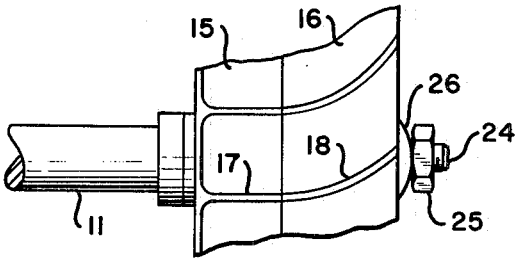
FIG. 3 is a partial plan view on a part of the radial turbine wheel, on an enlarged scale.

Referring now to the drawing wherein like reference numerals are used throughout the various views to designate like parts, the radial turbine wheel illustrated in FIGS. 1 to 3 and generally designated therein by reference numeral 12 which is non-rotatably connected with the turbine drive shaft 11 will be referred to hereinafter as turbine wheel for the sake of brevity. The turbine wheel 12 consists of a wheel body 13 and of blades 14 arranged thereon. The turbine wheel 12 is assembled of two parts generally designated by reference numerals 15 and 16 which contact with one another in a plane disposed transversely to the turbine wheel axis. The part 15 adjoining the turbine inlet includes the outer, plane section 17 of the blades 14 whereas the part 16 leading to the turbine outlet includes the inner section 18 of the blades which is strongly curved in the circumferential direction. The corresponding sections of the wheel body 13 are designated by reference numerals 19 and 20, respectively.

The parts 15 and 16 are provided with central bores 21 and 22, through which extends a section 23 of smaller diameter of the turbine shaft 11. A thread 24 (FIG. 3) is cut into the end of the shaft section 23, which projects out of the bore 22 of the part 16. A nut 25 screwed on the thread 24 presses a cup spring 26 with its outer edge against the one end face 27 of the wheel body 13 whereas the other end face 28 abuts with a hub 29 at a collar 30 of the turbine shaft 11. The two parts 15 and 16 of the turbine wheel 12 are rigidly pressed together by means of this threaded connection.

The part 15 of the turbine wheel 12 is non-rotatably connected with the turbine shaft 11 by means of an end-face toothed arrangement 31 provided at its hub 29 and at the collar 30 of the turbine shaft 11 and is simultaneously centered by the same. The part 16 is non-rotatably connected with the turbine shaft 11 by way of an internal toothed arrangement 32 machined into its stepped bore 22 and into the section 23 of the turbine shaft 11. A collar 33 at the section 23 of the turbine shaft 11 serves for centering the part 16 of the turbine wheel 12 at the outer end of the stepped bore 22. The end-teeth 31 and the internal teeth 32 have such a pitch and such an arrangement that the two parts 15 and 16 of the turbine wheel 12 can only be so assembled at one another that the sections 17 and 18 of the blades 14 pass over smoothly one into the other.

The part 15 of the turbine wheel 12 which is exposed to the particularly high inlet temperatures of the fresh gases is made of a heat-resistant ceramic material. In contrast thereto, the part 16 which includes the curved sections 18 of the blades 14, is made of a metallic material in the relatively inexpensive high quality or investment casting process. As a result of the slight specific weight of the ceramic part 15, the turbine wheel 12 is lighter in a desired manner and above all has a lower mass inertia moment than the customary radial turbine wheel made completely of metal.

Changes in length as a result of the different thermal coefficients of the used materials which will result during operation of the turbine wheel 12 between the parts 15 and 16, on the one hand, and the section 23 of the turbine shaft 11, on the other, can be compensated for by the deformation of the cup spring 26. The parts 15 and 16 as well as the connection thereof are therefore not endangered by thermal expansions.

Figure 4:
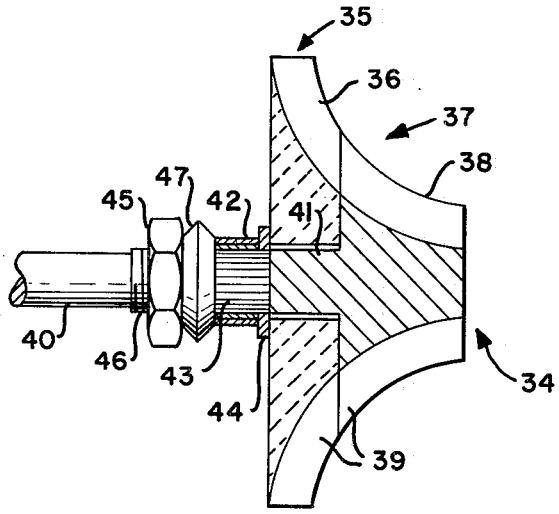
FIGS. 4 and 5 are longitudinal cross-sectional views through two further embodiments of radial turbine wheels in accordance with the present invention.

The turbine wheel generally designated by reference numeral 34 and illustrated in FIG. 4 is assembled in a manner similar to the preceding embodiment, of a part generally designated by reference numeral 35 which includes the outer sections 36 of the blades 39 and of a part generally designated by reference numeral 37 which includes the inner curved sections 38 of the blades 39. However, the part 37 is made of metallic material in one piece with the turbine shaft 40. The part 35 which consists of a ceramic material is arranged on the turbine shaft 40 by means of a bore 41. Additionally, a sleeve 42 is supported on the turbine shaft 40 which is non-rotatably connected to mesh with splines (unumbered) on the turbine shaft 40 by means of an internal toothed arrangement 43 and to mesh with the corresponding teeth (not shown) inside the end of part 35 of the turbine wheel 34 by means of an end-toothed arrangement 44. The end teeth 44 serve additionally for the centering of the part 35 of the turbine wheel 34. The inner teeth 43 and the end teeth 44 are formed integrally with the sleeve 42 and are shown in a side elevational view in FIG. 4.

Two cup springs 47 are clamped-in between the sleeve 42 and a nut 45 which is screwed on a section of the turbine shaft 40 provided with a thread 46. The cup springs 47 press together the two parts 35 and 37 of the turbine wheel 34 by way of the sleeve 42 so that they form a unit.

The elasticity of the cup springs 47 enables a compensation of different thermal expansions which results with the use of different materials. Different radial thermal expansions between the turbine shaft 40 and the part 35 of the turbine wheel 34 are made possible in that the diameter of the bore 41 of the part 35 is slightly larger than the diameter of the turbine shaft 40.

Figure 5:
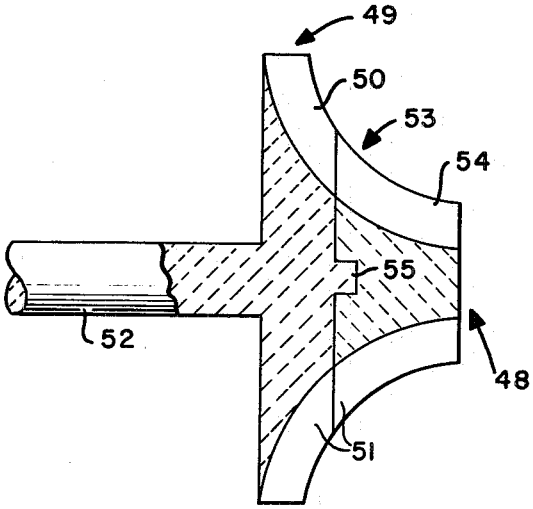

With the turbine wheel generally designated by reference numeral 48 and illustrated in FIG. 5, the part generally designated by reference numeral 49 having the outer plane sections 50 of the blades 51 is made of a ceramic material in one piece with the turbine shaft 52. The part generally designated by reference numeral 53 and having the inner curved sections 54 of the blades 51 consists also of a ceramic material which, however, has different properties. The part 53 is centered at an extension 55 provided at the part 49 and is securely connected with this part 49 by sintering.

Such a radial turbine wheel made completely of ceramic materials distinguishes itself with respect to a turbine wheel made of metal by its considerably lower weight and therewith by a lower mass inertia moment. This enables a high acceleration of the turbine wheel whereby the turbine wheel is suitable particularly for vehicle gas turbines, in which short response periods are particularly desired with rotational speed changes.

With turbine wheels made entirely or partly of ceramic materials, one utilizes for the first part adjoining the turbine inlet, a ceramic material of high strength whereas one utilizes for the second part leading to the turbine outlet such ceramic materials which are characterized by an easy working or machining possibility.

Thus, for example, the first part with the outer blade sections which have a plane or otherwise simple shape, may be made of hot-pressed silicon nitride. For example, reaction sintered silicon nitride is particularly suitable for the second part with the inner, essentially curved blade sections, which can be made also into complicated shapes by injection molding or other manufacturing processes.

In addition to the described examples, still many other advantageous material pairings are possible for an assembled radial turbine wheel. Thus, for example, a particularly heat-resistant alloy which, however, is difficult to machine may be used for the first part with the outer plane or only slightly curved blade sections whereas the second part with the inner, essentially strongly curved blade sections may consist of a metal suitable for high-quality or investment casting.

The radial turbine wheel of the present invention is also suitable for exhaust gas turbines.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A radial turbine wheel for a gas turbine, comprising: a turbine wheel body formed with blades, said turbine wheel body having a first part made of a ceramic material, said first part comprising an outer section of blades, and having a second part made of a different ceramic material, said second part comprising an inner centrally curved section of blades; and a turbine shaft on which said turbine wheel body is mounted, the turbine shaft and the first part of said turbine wheel body being made in one piece.

* * * * *